United States Patent [19]

Baldwin et al.

[11] 4,330,814

[45] May 18, 1982

[54] FLOOR RELAMPABLE LUMINAIRE

[75] Inventors: Samuel L. Baldwin, East Flat Rock; Marcus P. Hogue, Hendersonville, both of N.C.

[73] Assignee: General Electric Company, Schenectady, N.Y.

[21] Appl. No.: 137,138

[22] Filed: Apr. 4, 1980

[51] Int. Cl.[3] ..... F21V 29/00

[52] U.S. Cl. ..... 362/267; 362/268; 362/308; 362/331; 362/339; 362/374; 362/375

[58] Field of Search ..... 362/267, 268, 308, 331, 362/339, 374, 375

[56] References Cited

U.S. PATENT DOCUMENTS 3,291,979 12/1966 Logan ..... 362/277

*Primary Examiner*—Stephen J. Lechert, Jr.

*Attorney, Agent, or Firm*—Ernest W. Legree; Lawrence R. Kempton; Philip L. Schlamp

[57] ABSTRACT

Luminaire has refractor with a hinged door to provide access to the enclosed lamp for re-lamping operations. A prismatic optical device is provided on the luminaire to indicate when the door is fully closed on the refractor.

7 Claims, 5 Drawing Figures

7a
7b
7e
11e
11a
11
7g
7f
7h
7k
11d
11f 1
2
5
6
7
7a
7d
8
9
11

Fig. 2
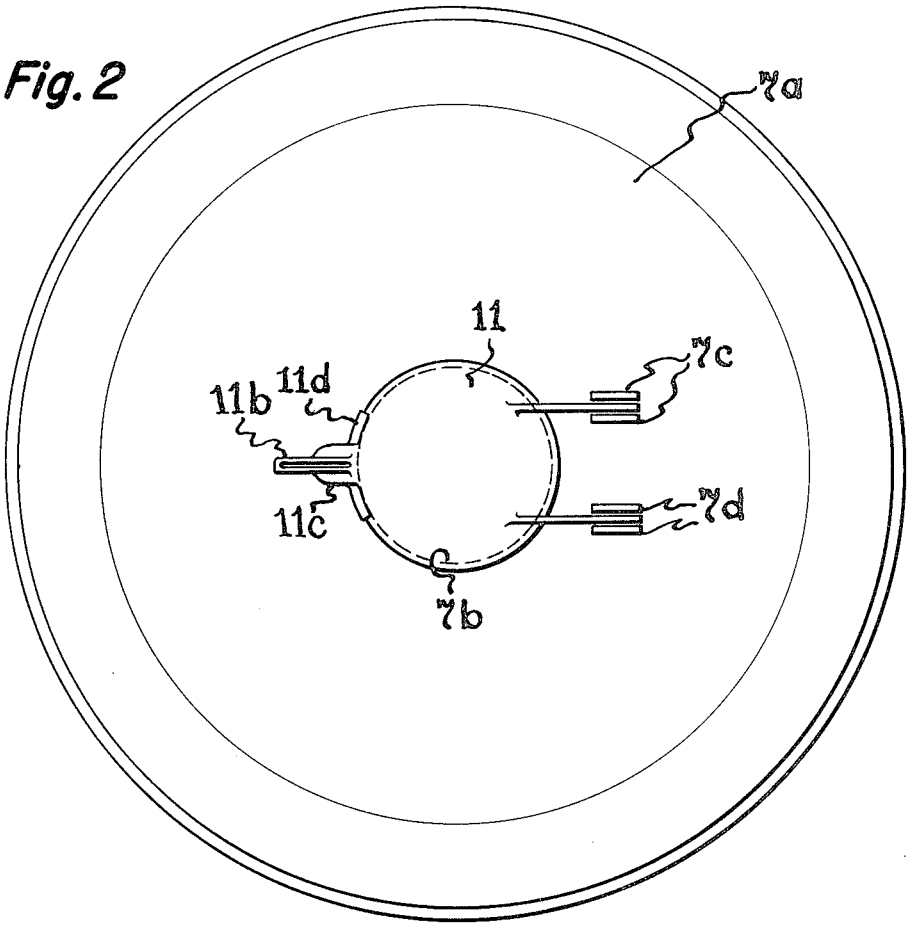
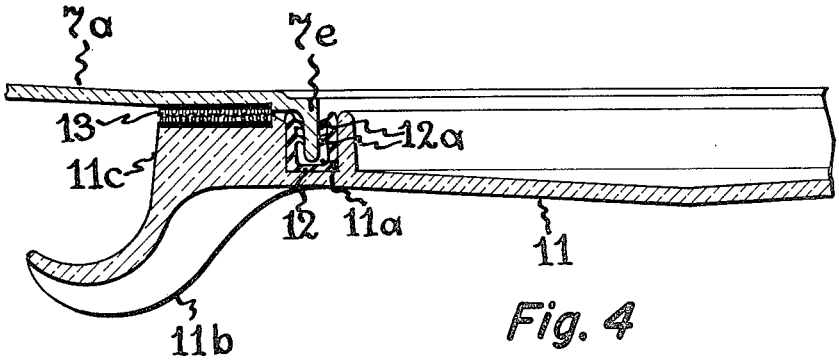
Fig. 4

FLOOR RELAMPABLE LUMINAIRE

The present invention relates to luminaires, and more particularly concerns a closure device for ceiling-mounted luminaires to provide access to the interior of the luminaire.

It is an object of the invention to provide a luminaire of the above type which has an improved closure arrangement.

It is a particular object of the invention to provide a luminaire of the above type having a light transmitting lens having an opening therein, and a light transmitting cover removable covering the opening for providing access to the luminaire interior from a remote position below the luminaire for maintenance service in other words a floor relampable luminaire.

Still another object of the invention is to provide a luminaire of the above type having an indicator device, and particularly an optical indicator, for indicating the closed condition of the lens opening cover as viewed from the remote position below the luminaire.

Other objects and advantages will become apparent from the following description and the appended claims.

With the above objects in view, the present invention in one of its aspects relates to a luminaire comprising, in combination, a housing having a bottom and an upper portion adapted to be secured to a support for holding the housing at a substantial height above the floor, the housing having light transmitting lens means extending substantially across its bottom, the lens means having an aperture therein, means for removably mounting a lamp with its base up in the housing above the aperture, the aperture being sufficiently large so that the lamp is accessible and removable therethrough, and light transmitting closure means secured to the lens means for movement between a closed position covering the aperture and an open position away from the aperture so as to provide access to the lamp from below the housing.

In accordance with a feature of the invention, the closure means and the lens means adjacent thereto are formed with co-acting prismatic means to provide an optical indicator device for indicating to an observer below the luminaire the closed condition of the closure means.

The invention will be better understood from the following description taken in conjunction with the accompanying drawings, in which:

FIG. 2 is a bottom plan view of the FIG. 1 luminaire;

FIG. 4 is a cross-sectional detailed view in enlarged scale of a portion of the luminaire lens and the associated closure device in closed position.

Figures 1, 5:
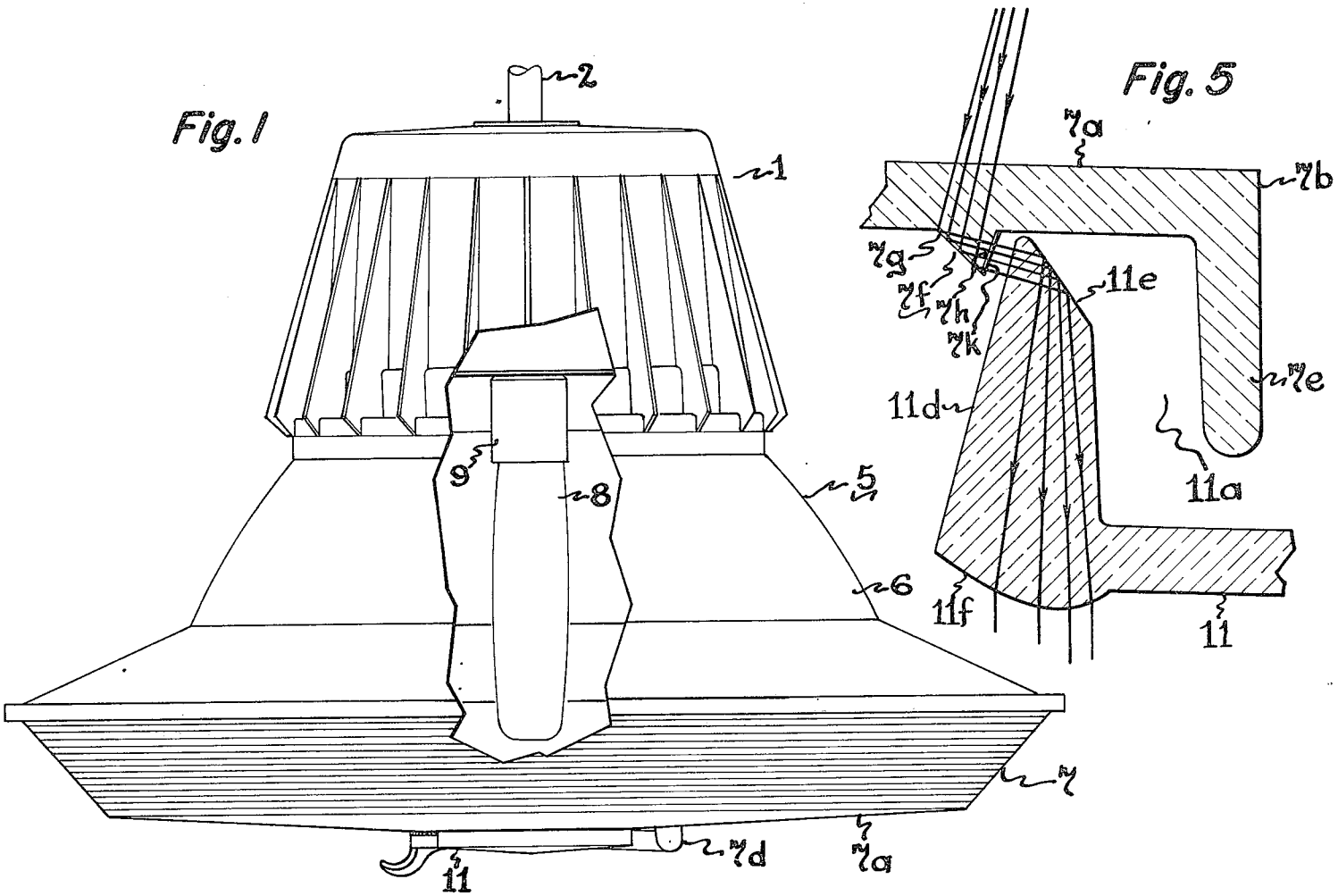
FIG. 1 is a view in elevation, partly broken away, of a luminaire embodying the invention.
FIG. 5 is an enlarged detailed view of the optical indicator embodied in the luminaire.

Referring now to the drawings, and particularly to FIG. 1, there is shown a luminaire of indoor industrial type having a somewhat dome-shaped ballast housing 1 connected to a wire conduit 2, such as a metal pipe, for supporting the luminaire at the desired height above the floor. Contained in ballast housing 1 are electrical components such as a ballast transformer and capacitor (not shown) for operating lamp 8, which is removably mounted with its base up in threaded socket 9 secured to a support in the ballast housing. Suspended from ballast housing 1 below the open bottom thereof is optical assembly 5 comprising reflector 6 and refractor 7. Lamp 8, which typically is a high intensity gaseous discharge lamp such as a mercury vapor or sodium vapor lamp, extends downwardly along the axis of the luminaire into the interior of the optical assembly.

Reflector 6 is formed of a somewhat conical upper portion open at its top and a lower outwardly flaring skirt portion. Refractor 7 is a shallow, somewhat dish-shaped transparent member having light control prisms extending around the outer surface of its peripheral wall. In the optical assembly, the lower rim of the reflector skirt portion mates with the upper flanged rim of refractor 7, and they are securely joined together in permanent sealed relation by suitable means.

Optical assembly 5 is typically detachably connected to ballast housing 1 by suitable means such as latches (not shown).

Other details of the optical assembly are disclosed in the patent to Willis et al U.S. Pat. No. 3,705,303 which relates to a somewhat similar type of luminaire, that patent being assigned to the same assignee as the present invention. As there disclosed, refractor 7 is of relatively large size and is typically made of a synthetic plastic material such as an acrylic resin.

In accordance with the present invention, the bottom or lens portion 7*a* of refractor 7 is formed with an aperture 7*b* in its central portion defined by rim flange 7*e* (see FIG. 3), the aperture being axially aligned below lamp 8 and being sufficiently large to allow passage of a lamp changer tool for access to the lap for re-lamping operations. Hingedly attached to lens 7*a* by means of hinge lugs 7*c*, 7*d* integral with the lens is transparent door 11, typically made of the same material as refractor 7. As seen best in FIG. 4, door 11 is formed on its inner marginal portion with a circumferentially extending groove or channel 11*a* in which is seated a U-shaped gasket 12 made, for example, of silicone rubber and having inwardly projecting nibs 12*a*. The arrangement is such that when door 11 is moved into closed position, nibs 12*a* come into sealing engagement with opposite sides of rim 7*e* of the refractor as the rim enters gasket channel 11*a*. Projecting outwardly from door 11 on the side opposite its hinged side is an integral hook portion 11*b* by means of which door 11 may be pulled down into open position.

Shown in the illustrated embodiment are detachable co-acting attaching means mounted respectively on an integral pad 11*c* formed on door 11 and on the mating surface of lens 7*a*, the attaching means shown comprising a nylon hook and loop fastener material 13 of known type, e.g., Velcro. Other suitable types of attaching devices may be used, such as a magnetic latch or a friction clip. Such readily detachable attaching means provide an additional holding function to securely retain the door in closed position, but such means are not always necessary and may be dispensed with in appropriate circumstances, especially where the gasket seal itself provides sufficient friction to hold the door 11 firmly closed.

Figure 3:
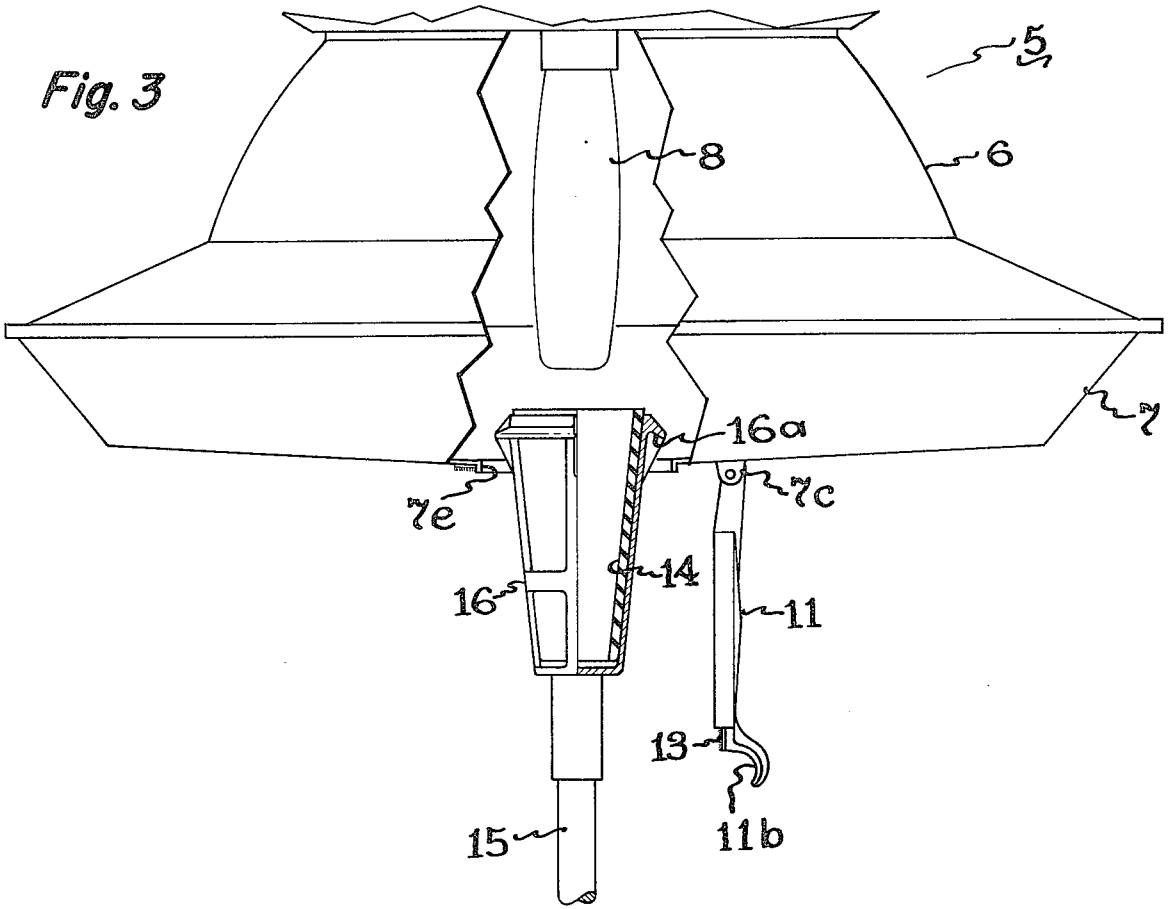
FIG. 3 is a view of the luminaire with the lens closure device in open position and a pole-mounted lamp changing device in association therewith.

FIG. 3 shows a type of pole-mounted lamp exchanger device which may be employed for removing and replacing the lamp and opening and closing door 11. As shown, the lamp exchanger comprises a conical lamp-engaging sleeve 14, made for example of rubber, received in a metal holder 16 which is mounted on top of pole 15 and formed near its top with an annular flange 16*a*, by means of which hook 11*b* of door 11 may be engaged for opening the door. With the door open, holder 16 is pushed up to engage sleeve 14 with lamp 8 and pole 15 is twisted to remove the lamp from its socket. After the lamp is replaced by the lamp exchanger, the latter may be used for pushing the door 11 into closed position.

In accordance with another feature of the invention, an optical indicator is provided for indicating to the observer below the luminaire when door 11 is in fully closed position. For this purpose, there is provided as shown in FIG. 5 in which gasket 12 has been omitted for clarity, an integral prismatic portion 11*d* formed on door 11 in the vicinity of hook portion 11*b* and extending a short distance circumferentially on the door (see FIG. 2). Prismatic portion 11*d* includes reflecting surface 11*e* at its top and convex surface 11*f* at its lower end. Formed on the lower surface of refractor lens 7*a* is a co-acting prism portion 7*f* comprising converging surfaces 7*g* and 7*h* and extending circumferentially on lens 7*a* a distance substantially co-extensive with prismatic portion 11*d* of door 11. Prism surface 7*h*, as seen in FIG. 5, faces reflecting surface 11*e* when door 11 is in closed position, and in accordance with the invention is provided with a light transmitting colored coating 7*k*, e.g., green, which is easily discernible against the background color of near white.

The arrangement is such, as indicated by the light rays depicted in FIG. 5, that light rays from lamp 8 pass through lens 7*a* and into prism portion 7*f*, are reflected from internal reflecting surface 7*g* so as to pass through color coated surface 7*h* and enter co-acting prism portion 11*d*. The rays are then reflected downwardly from internal reflecting surface 11*e* and pass through convex surface 11*f* which substantially collimates the rays and directs them downwardly, so that when the rays are viewed by an observer below the luminaire, the surface 11*f* appears to have the color of coated surface 7*h*. When door 11 is open or not fully closed, coated surface 7*h* is no longer being viewed through surface 11*f* and the color is not seen, thus indicating the open condition of door 11.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A floor-relampable luminaire comprising, in combination, a housing having a botttom and an upper portion adapted to be secured to a support for holding the housing at a substantial height above the floor, said housing having light-transmitting lens means extending substantially across its bottom, said lens means having an aperture therein, means for removably mounting a lamp with its base up in said housing above said aperture, said aperture being sufficiently large so that the lamp is accessible and removable therethrough, light-transmitting closure means hinged to said lens means for movement between a closed position covering said aperture and an open position providing access to the lamp from below said housing, and combined sealing and retaining means on said closure means and said lens means for sealing said closure means on said lens means around said aperture and for detachably holding said closure means in said closed position.

2. A luminaire as defined in claim 1, said combined sealing and retaining means comprising U-shaped gasket means on one of said lens means and said closure means and flange means on the other of said lens means said closure means fitting into and frictionally held by said U-shaped gasket means.

3. A luminaire as defined in claim 1, said closure means having hook means at the side opposite the hinged side for moving said closure means away from said aperture.

4. A luminaire as defined in claim 3, and auxiliary readily detachable attaching means at said opposite side of said closure means for holding the same in closed position.

5. A luminaire as defined in claim 1, said co-acting means comprising first prismatic means on said lens means and second prismatic means on said closure means arranged adjacent said first prismatic means when said closure means is in closed position, whereby light rays from the lamp are directed from said first prismatic means to said second prismatic means and thence to an observer below the luminaire to indicate the closed position of said closure means.

6. A luminaire as defined in claim 5, said first prismatic means having color means for coloring the light rays emanating therefrom.

7. A floor-relampable luminaire comprising, in combination, a housing having a bottom and an upper portion adapted to be secured to a support for holding the housing at a substantial height above the floor, said housing having light-transmitting lens means extending substantially across its bottom, said lens means having an aperture therein, means for removably mounting a lamp with its base up in said housing above said aperture, said aperture being sufficiently large so that the lamp is accessible and removable therethrough, light transmitting closure means secured to said lens means for movement between a closed position covering said aperture and an open position providing access to the lamp from below said housing, and optical indicating means comprising co-acting means on said lens means and said closure means for indicating to an observer below the luminaire the closed or open position of said closure means relative to said lens means by transmitting or failing to transmit some light rays from the lamp.

* * * * *